United States Patent [19]

Odashima et al.

[11] Patent Number: 4,540,860

[45] Date of Patent: Sep. 10, 1985

[54] PRESSURE RESPONSIVE SWITCH

[75] Inventors: Takeshi Odashima; Tsutomu Saito, both of Tokyo, Japan

[73] Assignee: Kabushiki Kaisha Saginomiya Seisakusho, Tokyo, Japan

[21] Appl. No.: 485,519

[22] Filed: Apr. 15, 1983

[30] Foreign Application Priority Data

| | | | |
|---|---|---|---|
| Oct. 5, 1982 | [JP] | Japan | 57-173901 |
| Dec. 27, 1982 | [JP] | Japan | 57-226600 |
| Feb. 10, 1983 | [JP] | Japan | 58-019589 |

[51] Int. Cl.[3] ..... H01H 35/32

[52] U.S. Cl. ..... 200/83 C; 200/83 P; 337/318

[58] Field of Search ..... 200/83 R, 83 C, 83 P; 337/318, 319, 320, 321

[56] References Cited

U.S. PATENT DOCUMENTS

| | | | |
|---|---|---|---|
| 2,754,388 | 7/1956 | Beeman | 200/83 P |
| 3,283,099 | 11/1966 | Liebermann et al. | 337/318 |

*Primary Examiner*—A. D. Pellinen
*Assistant Examiner*—Morris Ginsburg
*Attorney, Agent, or Firm*—Armstrong, Nikaido, Marmelstein & Kubovcik

[57] ABSTRACT

A pressure responsive switch in which a bellows abuts against a leaf spring at substantially the same point where a switch actuating rod abuts against the leaf spring. Within the casing, the bellows is attached to a first inner end and a switch section is provided at a second inner section. The actuating rod extends in a direction of the bellows expansion between said bellows and the switch section. A first end of the rod is positioned opposite the bellows. The leaf spring is interposed therebetween to counteract the bellows expansion and exert balanced force to the actuating rod.

8 Claims, 10 Drawing Figures

PRESSURE RESPONSIVE SWITCH

BACKGROUND OF THE INVENTION

This invention relates to a pressure responsive switch which is simple in structure and in which the load against a pressure responsive member can be effectively and properly determined.

A thermostat used in a refrigerator or a room air conditioning system is known from Published Japanese Utility Model application No. 50-9569, for example. In this conventional thermostat, a pressure responsive member comprises a bellows which converts temperature detected by a temperature sensor into mechanical movement and an L-shaped actuating plate having two arms which intersects at its fulcrum. In this thermostat, one of the two arms is positioned to abut against the bellows. Further, one end of a coil spring is locked on the other side of the actuating plate and the other end of said coil spring is screwed into an adjusting plate by a setting screw for adjusting the spring load. A cam means acts upon the adjusting plate so that the plate is tilted with one end thereof serving as a fulcrum to adjust the spring load. The adjusted spring load and the pressure responsive member interacts with each other. The pivotal movement of the actuating plate, which occurs concurrently with the movement of the pressure responsive member, causes a switch contact to be opened or closed through an actuating rod. This structure has many components and is therefore complicated.

A simplified thermostat is described in U.S. Pat. No. 3,283,099, in which an actuating plate is omitted and a leaf spring of a deformed U shape having a long arm and a short arm is employed. The long arm of the U-shaped leaf spring abuts and acts against a pressure responsive member. In this case, a point where an actuating rod for the switch abuts against the leaf spring is spaced apart from a point where the long arm acts against the pressure responsive member. The part between these separated points acts as a rigid portion of the leaf spring to transmit the movement of the bellows through the actuating rod to the switch.

In other words, the long arm of the U-shaped leaf spring which is elastic as a whole is partially made rigid. Therefore, transmission through such a rigid part is inaccurate to a certain extent. Further, the long arm must be significantly elongated in order to provide the leaf spring with a required elastic property. As a result, the radius of curvature of the arcuate bent portion must be increased to effectively utilize the elasticity of the arcuate bent portion of the leaf spring as a whole. Thus, even if the mechanism of the pressure responsive switch is simplified, a compact structure cannot be achieved.

SUMMARY OF THE INVENTION

In consideration of the prior art defects as described above, an object of this invention is to use a deformed U shape type leaf spring having a long arm and a short arm such that a point where an actuating rod abuts against said long arm in order to transmit a force to a switch substantially coincides with or be close to a point where the middle portion of the long arm acts against a pressure responsive member to such an extent that the elastic displacement may not occur. As a result, the entire leaf spring can be utilized as an elastic member to accurately transmit the operation of the pressure responsive member to the switch through the actuating rod. In accordance with this invention, since the U-shaped leaf spring can be reduced in size, a compact pressure responsive switch having a simple mechanism can be realized.

BRIEF DESCRIPTION OF THE DRAWINGS

Embodiments of this invention will be described below with reference to the accompanying drawings, wherein.

DETAILED DESCRIPTION OF THE EMBODIMENTS

Figure 1:
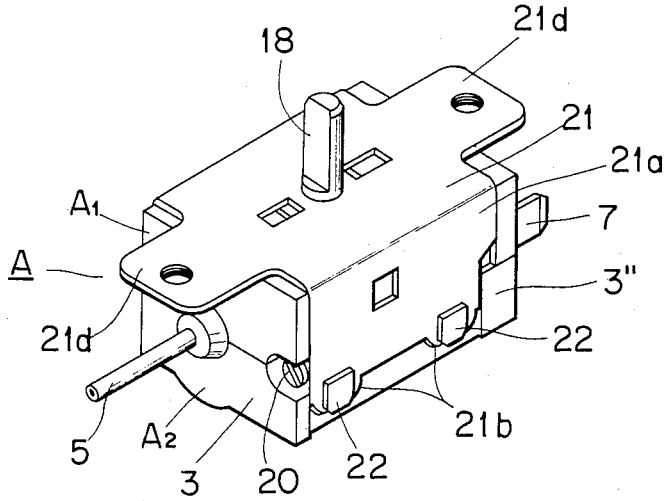
FIG. 1 is a perspective view of a thermostat according to an embodiment of this invention.
Figure 2:
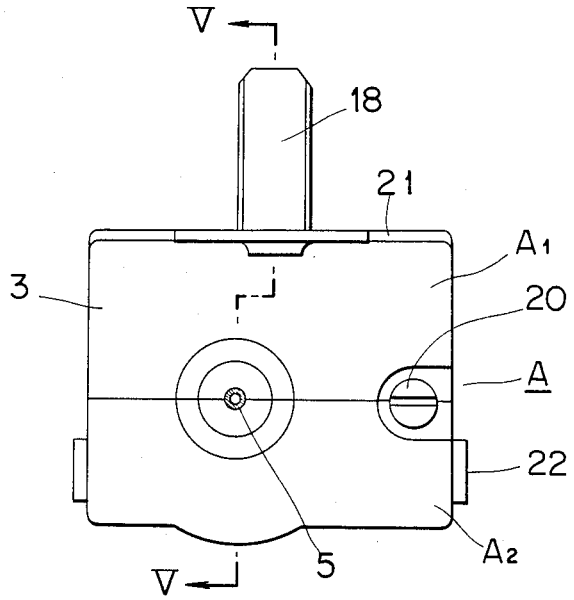
FIG. 2 is a left side view of the thermostat of FIG. 1.
Figure 3:
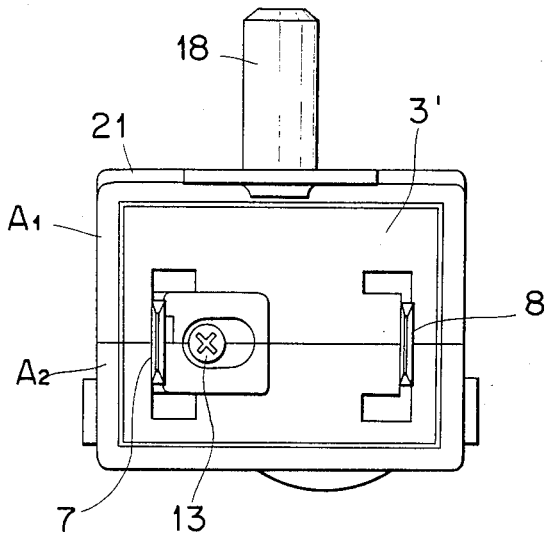
FIG. 3 is a right side view of the thermostat of FIG. 1.

In the drawings, a casing A is made of a synthetic resin and composed of a front casing section A1 and a rear casing section A2, which are coupled to each other by a means as described later. The front and rear casing portions A1 and A2 have a front wall 1 and a rear wall 2, respectively, and are combined to form four peripheral walls 3, 3', and 3''.

One peripheral wall 3 or a first inner end of the casing is provided with a bellows 4 which serves as pressure responsive means. The open end of the bellows 4 is soldered or welded to a fixing surface 6*a* of a bottom plate 6. One end of a capillary 5 is welded to said bottom plate in such a manner that the end of the capillary opens into the bellows 4. The other end of the capillary is connected to temperature sensor not shown such that pressure change is received therefrom.

A switch S is provided on the peripheral wall 3' opposing the peripheral wall 3. A fixed contact terminal 7 and a movable contact terminal 8 are secured to said peripheral wall 3' so as to extend through the latter. The fixed contact terminal 7 has a fixed contact 9. A movable contact plate 11 having a movable contact 10 on one end thereof is fixed to the movable contact terminal 8 at the other end thereof by a calking means or the like and kept in the electrically conductive state. A snap actuating plate 11*a* is formed by cutting the movable contact plate 11 in a known manner. Further, a quick reverse action spring 12 is provided between the movable contact plate 11 and the snap actuating plate 11*a*. The peripheral wall 3' is further provided with a differential setting screw 13 for adjusting the distance between the contacts.

The movable surface 4*a* of the bellows 4 is opposed to the movable contact plate 11 or the snap actuating plate 11*a* of the switch S. An actuating rod 14 is arranged to transmit the expansion of the bellows 4 to the switch S.

A head 14*a* at a first end of the actuating rod 14 abuts against the movable surface of the bellows 4 and a locking portion 14*b* at a second end of the rod is connected to the snap actuating plate 11*a*. The actuating rod transmits the expansion of the bellows 4 to the switch S to open and close the latter under the action of a leaf spring described below.

A leaf spring 16 is provided to act against the operation of the bellows 4 between the bellows 4 and the switch S to determine the control temperature for a controlled section. The leaf spring 16 is formed by bending a thin rectangular spring plate having a predetermined width. That is, a long arm 16*b* contiguous with a short arm 16*c* through an arcuate bent portion 16*a* forms the leaf spring of a deformed U shape. The middle portion of the longer arm 16*b* has a through hole 16*d* into which the actuating rod 14 is inserted with play. Both side edges 16*d*$_1$ of the through hole 16*d* which extend in the directions intersecting with the direction of extension of the long arm are arranged to abut against the head 14*a* of the actuating rod 14 which projects opposite to the side edges 16*d*$_1$ to abut against the bellows so that the leaf spring 16 acts against the bellows 4 through the actuating rod 14. Therefore, both side edges 16*d*$_1$ of the long arm 16*b* provide a point X where the leaf spring acts against the bellows 4 serving as a pressure responsive member, as well as a point Y where the leaf spring abuts against the actuating rod 14. The points X and Y completely coincide with each other.

A driving piece 17*a* formed by bending part of a slidable adjusting plate 17 is arranged to abut against the short arm 16*c* of the leaf spring 16. A projection 17*a*$_1$ of the driving piece 17*a* is engaged in a hole 16*c*$_1$. The slidable adjusting plate 17 is provided to be movable in a recess 1*a* of the front wall 1 of the front casing section A1 in the axial direction of the actuating rod 14. The adjusting plate has an elongated hole 17*b* extending in the direction of its movement, in which hole a bearing portion 1*b* for a cam shaft 18 is positioned. The driving piece 17*a* extends through a hole not shown which is formed in the front wall 1. Thus, the slidable adjusting plate 17 is situated laterally with respect to the line intersecting with the direction of extension of the leaf spring 16.

An engaging projection 17*c* is provided to protrude from one end of the elongated hole 17*b* of the slidable adjusting plate 17. A cam plate 19 provided on the cam shaft 18 engages the projection 17*c*.

Another setting screw 20 for adjusting the load upon the leaf spring is secured through a divided threaded hole 20' to the peripheral wall 3 on the side of the bellows in a position where the front and rear casing sections A1 and A2 are joined together. A locking neck portion 20*a* at the inner end of the setting screw 20 is engaged in a locking notch 16*e* formed in a long arm end of the long arm 16*b*. Therefore, advance or retraction of the setting screw 20 displaces the fulcrum of the U-shaped leaf spring 16.

Figure 4:
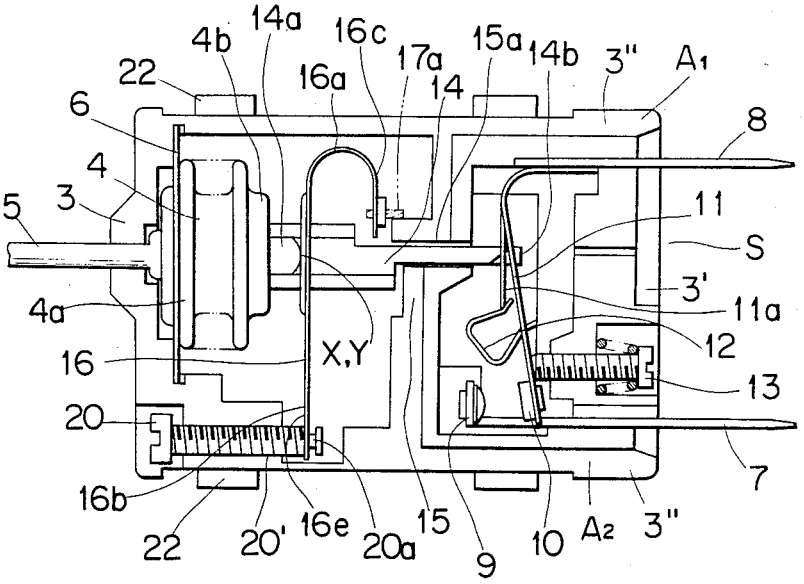
FIG. 4 is a sectional view illustrating the internal mechanism with a front casing section being removed.
Figure 5:
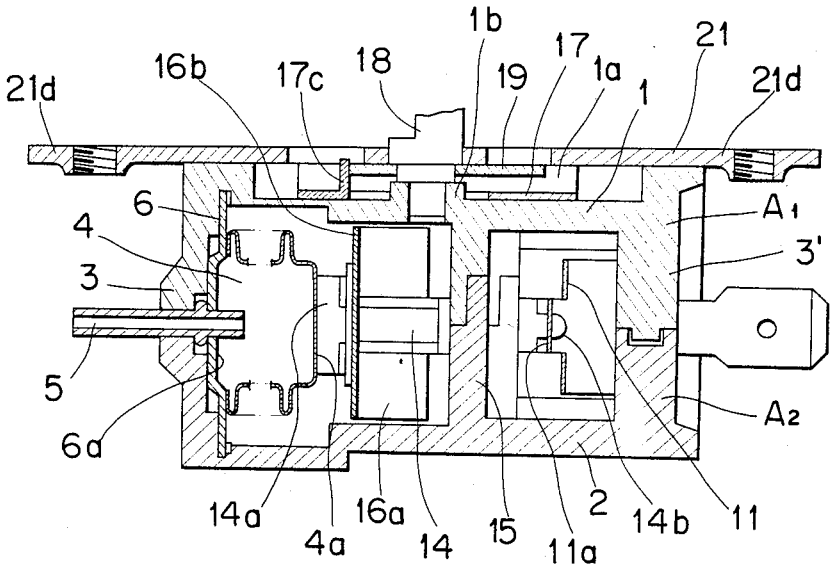
FIG. 5 is a sectional view taken along line V—V of FIG. 2.
Figure 7:
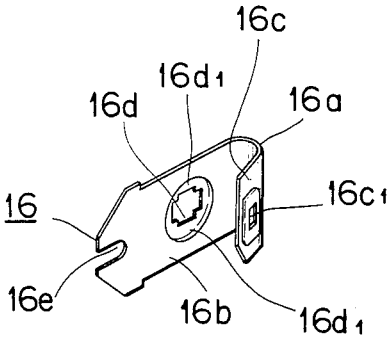
FIG. 7 is a perspective view of a leaf spring used in above embodiment.
Figure 10:
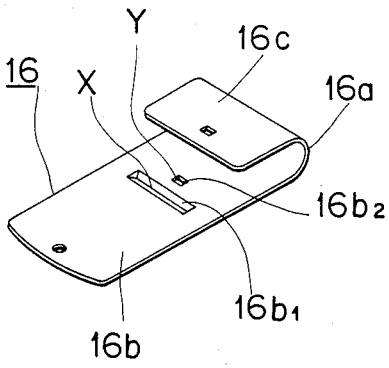
FIG. 10 is a perspective view of a leaf spring used in the embodiment of FIG. 9.
Figure 6:
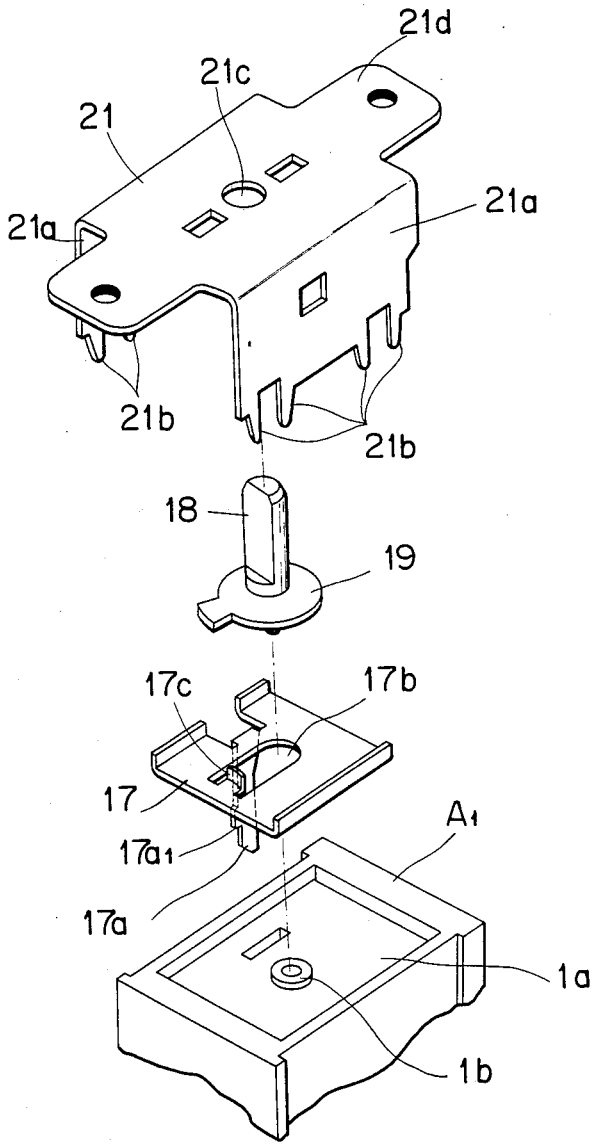
FIG. 6 is an exploded perspective view illustrating main components.

In assembly, the bellows 4, switch S, terminals 7 and 8, setting screws 13 and 20, actuating rod 14 as well as leaf spring 16 are arranged and accommodated in place within the rear casing section A2, as shown in FIG. 4. Then, the front casing section A1 is combined with the rear casing section A2.

A metal cover plate 21 serves to cover the front wall 1. It has connecting plates 21*a* bent over the opposing peripheral walls 3'' extending in the directions intersecting with the other peripheral walls 3 and 3' on which the bellows 4 and the switch S are mounted, respectively. The ends of the connecting plates 21*a* are joined to calking connector pieces 21*b* between which are received connecting projections 22 formed on the outer surfaces of the peripheral walls 3'' of the rear casing section A2. During assembly, the ends of the calking connector pieces 21*b*, are calked with the connecting projections 22 so that the coupling of the front casing section A1 with the rear casing section A2 is ensured simultaneously when the cover plate 21 is secured to the casing A.

A hole 21*c* into which the cam shaft 18 is inserted is formed at the center of the cover plate 21. Both side portions of the cover plate are contiguous with mounting plates 21*d* extending outwardly. Thus, the cam shaft 18 is stably held by the hole 21*c* of the cover plate 21 and the bearing portion 1*b* of the front wall 1.

In the arrangement as described above, when a gas pressure corresponding to the temperature of the temperature sensor is transmitted to the bellows 4 through the capillary 5, the pressure within the bellows and the load of the leaf spring 16 acts against each other through the actuating rod 14. Therefore, the leaf spring resiliently counteracts the bellows expansion to exert balanced force on the actuating rod in cooperation therewith. In other words, any difference between the pressure within the bellows and the load of the leaf spring causes the actuating rod 14 to move in the axial direction. This movement of the actuating rod 14 is further transmitted to the switch S to drive the snap actuating plate 11*a*. As a result, the contacts 9 and 10 are opened or closed through the quick reverse action spring 12 or the movable contact plate 11.

The operating temperature is determined as follows: While the cam plate 19 of the cam shaft 18 is held in a certain fixed position, the setting screw 20 is advanced or retracted to adjust the spring load against the bellows 4. Consequently, a proper temperature for switch-off operation is set within an adjustable temperature range. A temperature for switch-on operation is determined by advancing or retracting the differential setting screw 13.

The switch is incorporated in a refrigerator or a room air conditioning system in this state. After incorporation, the operating temperature is determined by pivoting the cam shaft to move the slidable adjusting plate 17 by means of the cam plate, and then controlling the short arm 16*c* of the leaf spring 16 by the driving plate 17*a* to vary the degree of bend of the arcuate bent portion 16*a*.

Figure 8:
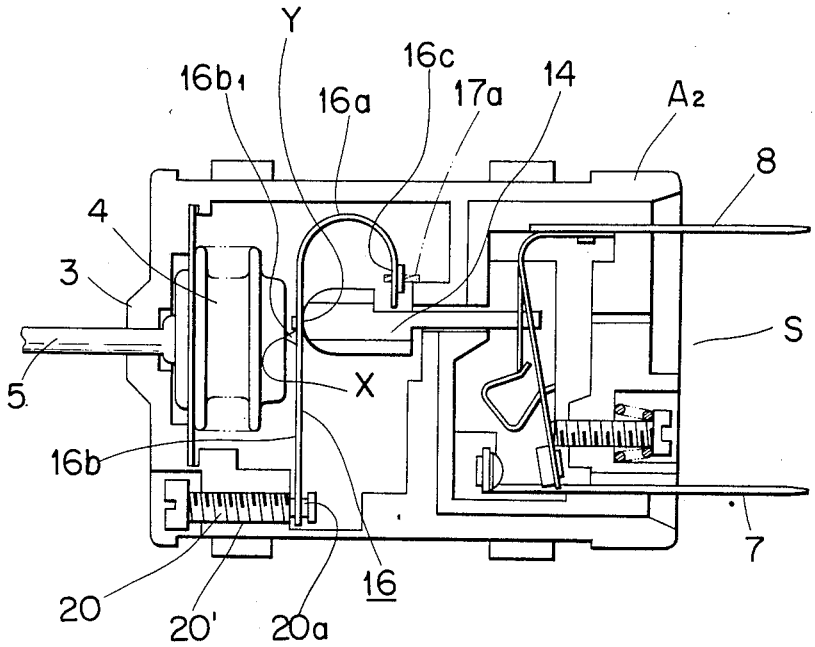
FIG. 8 and FIG. 9 are respectively sectional views illustrating internal mechanisms of further embodiments of this invention, with a front casing section being removed.

In an embodiment shown in FIG. 8, the long arm 16*b* of the U-shaped leaf spring 16 directly abuts and acts against the bellows 4 at its projection 16*b*$_1$. The end of the actuating rod 14 is engaged in a hole 16*b*$_2$ formed adjacent to the projection 16*b*$_1$ and abuts against the circumferential edge of the hole.

In this case, a point Y where the actuating rod abuts against the long arm 16*b* is arranged to substantially coincide with a point X where the long arm 16*b* of the leaf spring 16 acts against the bellows 4.

Figure 9:
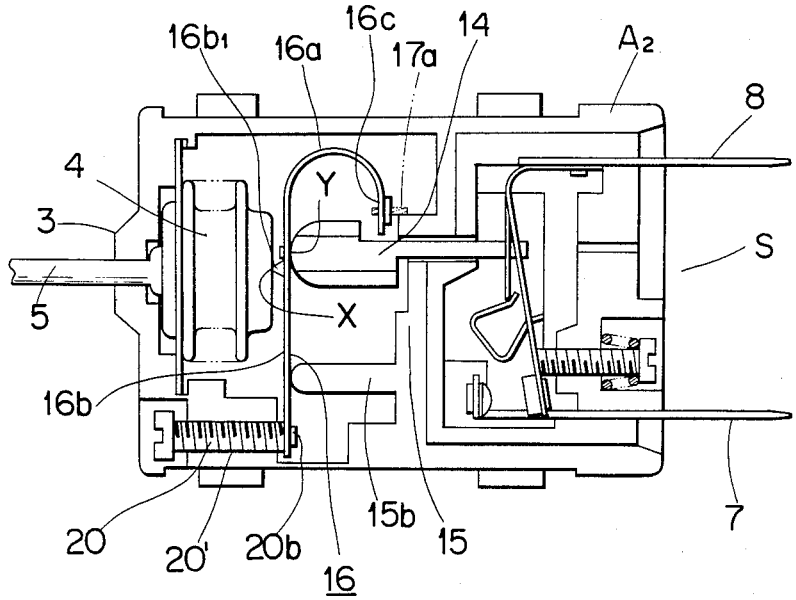

A further embodiment shown in FIG. 9 is different from that of FIG. 8 in that the fulcrum of the long arm 16*b* is in a position where it abuts against the projection 15*b* of a partition wall 15. In this case, the long arm 16*b* is urged toward the projection by the inner end 20*b* of the setting screw 20 to change the elastic property of the long arm without displaying the fulcrum, in order to adjust the first stage load on the bellows 4. In this embodiment, the effective length of the leaf spring is reduced to increase the elastic load. Consequently, the load on the bellows and thus the pressure within the bellows may act at a higher level.

In summary, in accordance with this invention, the U-shaped leaf spring as a whole serves as an elastic member and the movement of the pressure responsive member can be precisely transmitted to the switch. As a result, a compact pressure responsive switch of a simple structure can be achieved.

What is claimed is:

1. A pressure responsive switch comprising:

a casing having a first inner end and a second inner end; a bellows provided within said casing at said first inner end having an opening to receive air pressure changes from outside the casing for expansion of said bellows within the casing;

a switch section provided within the casing at said second inner end;

an actuating rod longitudinally extending in an axial direction of said expansion of the bellows between said bellows and said switch section, and having a first end axially aligned with and substantially opposite said bellows and a second end to operate the switch section; and resilient means through which said rod extends for resiliently counteracting said expansion of the bellows to exert balanced force on the actuating rod in cooperation therewith, and means actuated by said actuating rod to cause operation of a switch in said switch section.

2. A pressure responsive switch according to claim 1, wherein said resilient means includes a leaf spring.

3. A pressure responsive switch according to claim 2, wherein said leaf spring is of a U shape and has a long arm, a short arm, and a bent portion.

4. A pressure responsive switch according to claim 3, wherein said long arm has a hole therein through which said actuating rod is inserted, said first end of the actuating rod abutting against the long arm and the bellows.

5. A pressure responsive switch according to claim 3, wherein said first end of the actuating rod abuts against the long arm whereas said long arm of the leaf spring abuts against said bellows.

6. A pressure responsive switch according to claim 3, wherein said long arm has a long arm end screw-fixed.

7. A pressure responsive switch according to claim 6, further including a fulcrum to support the leaf spring against the expansion of the bellows between said long arm end and said bellows.

8. A pressure responsive switch according to claim 3, wherein said short arm has a short arm end subject to cam action adjustment from outside the casing.

* * * * *